US011430356B2

(12) United States Patent
Chambers et al.

(10) Patent No.: US 11,430,356 B2
(45) Date of Patent: Aug. 30, 2022

(54) ILLUMINATING DISPLAY WINDOW AND MERCHANDISER DISPLAY UNIT COMPRISING SAME

(71) Applicant: TRUE MANUFACTURING CO., INC., O'Fallon, MO (US)

(72) Inventors: Connor Chambers, Maryland Heights, MO (US); Jason Harmon, Wildwood, MO (US); Mark Sylvester, St. Charles, MO (US)

(73) Assignee: TRUE MANUFACTURING CO., INC., O'Fallon, MO (US)

( * ) Notice: Subject to any disclaimer, the term of this patent is extended or adjusted under 35 U.S.C. 154(b) by 0 days.

(21) Appl. No.: 17/025,316

(22) Filed: Sep. 18, 2020

(65) Prior Publication Data

US 2021/0005121 A1 Jan. 7, 2021

Related U.S. Application Data

(63) Continuation of application No. 16/058,739, filed on Aug. 8, 2018, now Pat. No. 10,810,914.

(Continued)

(51) Int. Cl.
*G09F 23/00* (2006.01)
*F21V 9/32* (2018.01)

(Continued)

(52) U.S. Cl.
CPC ..... *G09F 23/0058* (2013.01); *A47F 1/00* (2013.01); *F21V 9/32* (2018.02); *F21V 11/16* (2013.01);

(Continued)

(58) Field of Classification Search
CPC ..... G09F 23/0058; A47F 1/00; F21V 9/32; F21V 11/16; F21W 2131/405; F25D 2327/001; F25D 2400/36
See application file for complete search history.

(56) References Cited

U.S. PATENT DOCUMENTS 4,449,761 A 5/1984 Davis et al.
4,886,327 A 12/1989 Amstutz et al.

(Continued)

FOREIGN PATENT DOCUMENTS

KR 101349159 B1 1/2014
WO 2014069791 A1 5/2014

OTHER PUBLICATIONS

US 6,322,905 B1, 12/2012, Parker et al. (withdrawn)

*Primary Examiner* — Evan P Dzierzynski
(74) *Attorney, Agent, or Firm* — Stinson LLP

(57) ABSTRACT

An illuminating display window has a window pane and a graphic element including fluorescent material. The graphic element has a major surface facing forward and a perimeter surface extending transverse to the major surface. An electromagnetic radiation source is configured to emit electromagnetic radiation to the perimeter surface of the graphic element. The radiation includes electromagnetic radiation having a wavelength in a non-visible spectrum. The graphic element fluoresces in response to the non-visible radiation to transmit visible light to an observer in front of the window pane. To form the graphic element, fluorescent ink can be deposited on a panel in a predefined pattern or a fluorescent panel could be shaped to have a predefined shape.

20 Claims, 4 Drawing Sheets

Related U.S. Application Data

(60) Provisional application No. 62/542,871, filed on Aug. 9, 2017.

(51) Int. Cl.

| | |
|---|---|
| ***F21V 11/16*** | (2006.01) |
| ***F25D 23/02*** | (2006.01) |
| ***F25D 27/00*** | (2006.01) |
| ***G09F 13/18*** | (2006.01) |
| ***G09F 13/22*** | (2006.01) |
| ***A47F 1/00*** | (2006.01) |
| *F21W 131/405* | (2006.01) |
| *F21Y 115/10* | (2016.01) |
| *F21Y 103/10* | (2016.01) |

(52) U.S. Cl.

CPC ..... *F25D 23/028* (2013.01); *F25D 27/00* (2013.01); *G09F 13/18* (2013.01); *G09F 13/22* (2013.01); *F21W 2131/405* (2013.01); *F21Y 2103/10* (2016.08); *F21Y 2115/10* (2016.08); *F25D 2327/001* (2013.01); *F25D 2400/36* (2013.01); *G09F 2013/184* (2013.01); *G09F 2013/1868* (2013.01); *G09F 2013/222* (2013.01)

(56) References Cited

U.S. PATENT DOCUMENTS 5,027,258 A * 6/1991 Schoniger ..... G09F 13/20 362/629
5,363,611 A 11/1994 Richardson et al.
5,555,654 A 9/1996 Hermann
5,613,751 A 3/1997 Parker et al.
5,699,676 A 12/1997 Trulaske, Sr.
5,783,264 A 7/1998 Howes
5,879,070 A 3/1999 Severloh
5,937,666 A 8/1999 Trulaske, Sr.
5,944,862 A 8/1999 Howes
6,059,420 A 5/2000 Rogers
6,148,563 A 11/2000 Roche et al.
6,210,013 B1 4/2001 Bousfield
6,406,108 B1 6/2002 Upton et al.
6,568,821 B1 5/2003 Page et al.
7,246,932 B2 7/2007 Burtsev et al.
7,260,454 B2 * 8/2007 Pickering ..... H01H 13/702 701/2
7,364,342 B2 4/2008 Parker et al.
7,467,887 B2 12/2008 Parker
7,492,346 B2 2/2009 Manabe et al.
7,736,043 B2 6/2010 Parker
8,092,068 B2 1/2012 Parker et al.
8,123,393 B2 2/2012 Parker
8,142,063 B2 3/2012 Parker
8,215,816 B2 7/2012 Parker
8,308,330 B2 11/2012 Nath
8,439,461 B2 5/2013 Kim
8,523,374 B2 9/2013 Pae
8,523,375 B2 9/2013 Kim et al.
8,556,440 B2 10/2013 Hong
2003/0003278 A1 * 1/2003 Narita ..... B41M 3/144 428/195.1
2004/0160538 A1 8/2004 Li et al.
2008/0024047 A1 1/2008 Juo et al.
2008/0148753 A1 6/2008 Welker et al.
2009/0244884 A1 10/2009 Trulaske, Sr.
2010/0180615 A1 * 7/2010 Linder ..... F25D 27/00 62/248
2010/0242515 A1 9/2010 Kim
2011/0052842 A1 3/2011 Choy et al.
2012/0031124 A1 2/2012 McDaniel
2013/0063326 A1 * 3/2013 Riegel ..... G02F 1/133615 345/4
2013/0119847 A1 5/2013 Seo et al.
2014/0144083 A1 * 5/2014 Artwohl ..... G09F 23/065 49/70
2014/0286048 A1 9/2014 Riello et al.
2016/0095450 A1 * 4/2016 Trulaske, Sr. ..... A47F 3/0434 312/116
2018/0061283 A1 3/2018 Kim et al.
2018/0194203 A1 * 7/2018 Salter ..... G07C 9/00

* cited by examiner

ILLUMINATING DISPLAY WINDOW AND MERCHANDISER DISPLAY UNIT COMPRISING SAME

CROSS-REFERENCE TO RELATED APPLICATIONS

This application is a continuation of U.S. patent application Ser. No. 16/058,739, filed Aug. 8, 2018, and entitled ILLUMINATING DISPLAY WINDOW AND MERCHANDISER DISPLAY UNIT COMPRISING SAME, which claims priority to U.S. Provisional Patent Application Ser. No. 62/542,871, filed Aug. 9, 2017, entitled ILLUMINATING DISPLAY WINDOW AND MERCHANDISER DISPLAY UNIT COMPRISING SAME, each of which is hereby incorporated by reference in its entirety.

FIELD

The present disclosure generally relates to an illuminating display window and a merchandiser display unit comprising the illuminating display window.

BACKGROUND

Illuminating display windows are often used in retail to draw attention to merchandise. For example, an Illuminating display window can be included in the door of a merchandiser refrigerator unit to advertise the merchandise held inside the unit while also permitting a customer to see the merchandise through the window. Typically, an illuminating display window comprises parallel, opposing transparent or semi-transparent window panes, and an acrylic sheet with an engraved or etched graphic between the window panes. One or more light sources are mounted at a perimeter of the window to direct light toward the edge of the acrylic sheet. The light transmitted in the acrylic sheet is reflected internally by the engraved or etched graphic formed in the sheet, thereby illuminating the graphic. This arrangement is known as an "edge-lit" window.

SUMMARY

In one aspect, an illuminating display window generally comprises a window pane having a perimeter edge margin, a front surface, a rear surface opposite the first surface, and a thickness extending from the front surface to the rear surface. A graphic element comprises a fluorescent material. The graphic element is supported on the window at a location inboard of the perimeter edge margin of the window pane. The graphic element has a major surface facing forward and a perimeter surface extending transverse to the major surface and defining a perimeter of the graphic element. An electromagnetic radiation source is configured to emit electromagnetic radiation having a wavelength in a non-visible spectrum. The electromagnetic radiation source is supported on the window at a location adjacent the perimeter edge margin of the window pane. The electromagnetic radiation source is configured to emit the electromagnetic radiation to the perimeter surface of the graphic element whereby the graphic element fluoresces to transmit visible light that is visible to an observer in front of the window pane.

In another aspect, a method of forming an graphic element for an illuminating display structure generally comprises at least one of depositing fluorescent ink on a plate in a predefined pattern; and shaping a fluorescent panel to have a predefined shape.

Other aspects and features will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
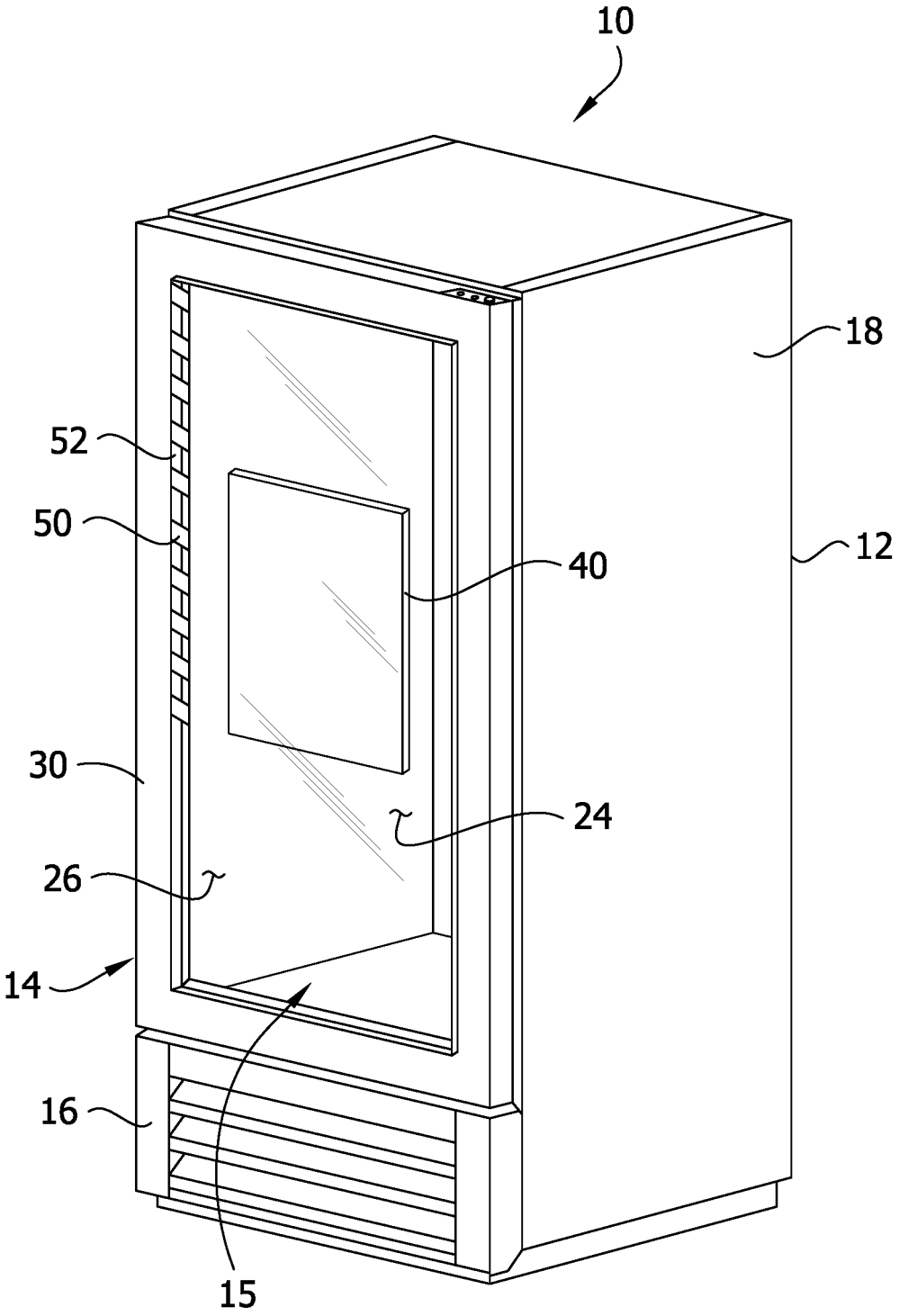
FIG. 1 is a perspective of a merchandiser refrigerator including door having an illuminating display window.

As illustrated in FIG. 1, one embodiment of a merchandiser display unit is generally indicated at reference number 10. The illustrated merchandiser display unit is in the form of a merchandiser refrigerator 10 comprising a cabinet 12 and a door, generally indicated at 14, which is movably (e.g., slidably or pivotably) mounted on the cabinet for selectively opening and closing the cabinet. As will be explained in further detail below, the door 14 comprises an illuminating display window, generally indicated at 15. Although in the illustrated embodiment the illuminating display window 15 is part of the door 14, in other embodiments the illuminating display window may be incorporated in a merchandiser display unit in other ways, such as forming part or an entirety of a side panel of the unit. Moreover, the illuminating display window 15 may be incorporated in other types of merchandiser display units other than a merchandiser refrigerator.

Referring still to FIG. 1, the cabinet 12 of the merchandiser refrigerator 10 has a lower portion 16 defining a refrigerating system housing, and an upper portion 18 defining a refrigerated interior 24 in which merchandise/product is displayed. Some or all of the components of a refrigerating system (not shown) for keeping the refrigerated interior 24 cold (e.g., below room temperature) may be disposed in the lower portion 16 of the cabinet 12. The upper portion 18 of the cabinet 12 defines an opening 26 in communication with the refrigerated interior 24. In the illustrated embodiment, the door 14 is mounted on the upper portion 18 adjacent the opening 26 of the cabinet 12 by a hinge to allow the door to be selectively opened and closed, thereby opening and closing the refrigerated interior 24, respectively. While the illustrated embodiment includes a single hinged door 14, it will be understood that other numbers of doors may be used in other embodiments. The door may be of other constructions in other embodiments for allowing opening and closing of the door. For example, the door may be a sliding door or other type of door. As used herein, the terms "front," "rear," "forward," "rearward," and like terms denote relative locations or positions of components or structures of the merchandiser display unit 10 when orientated toward an observer.

Figure 2:
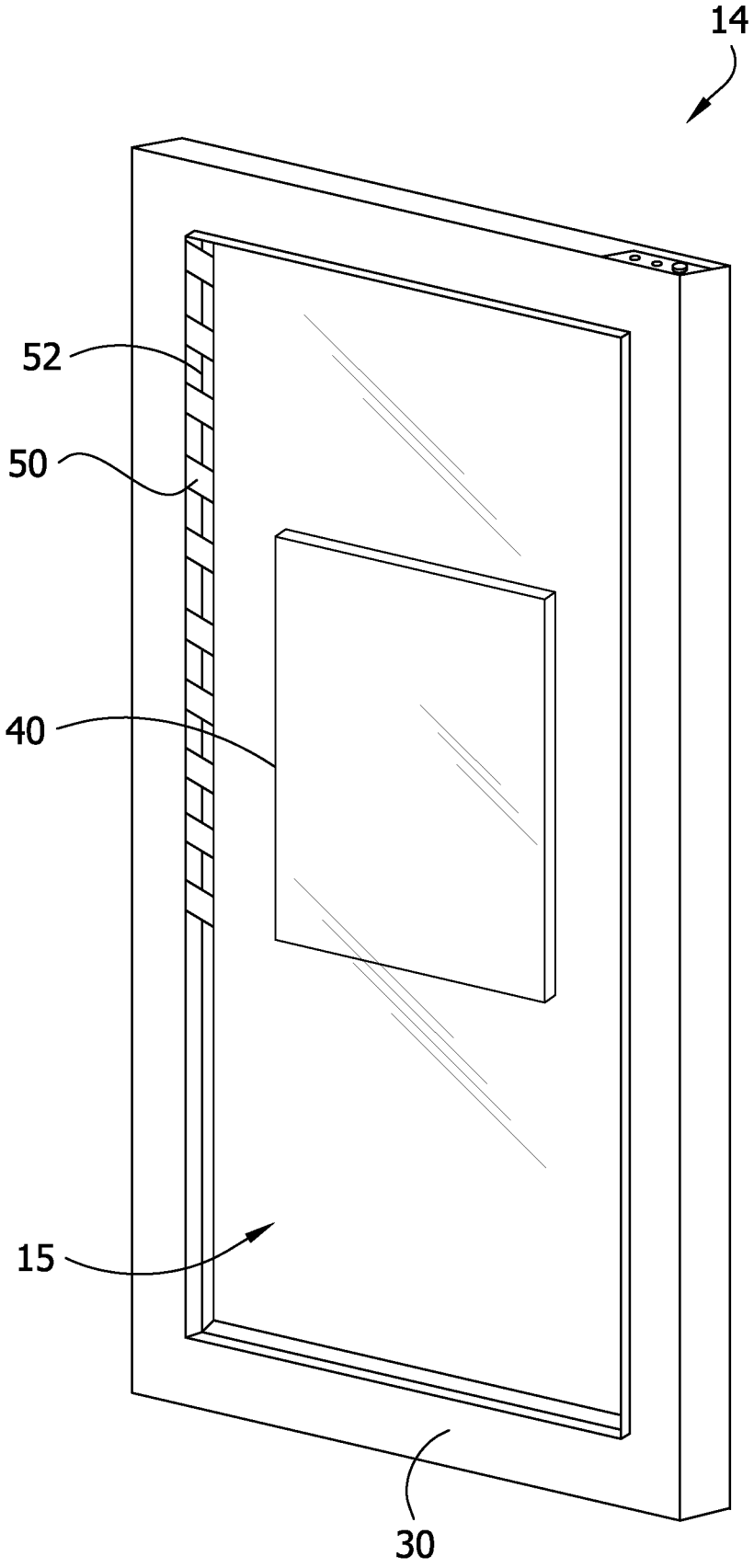
FIG. 2 is a perspective of the door of the refrigerator.
Figure 3:
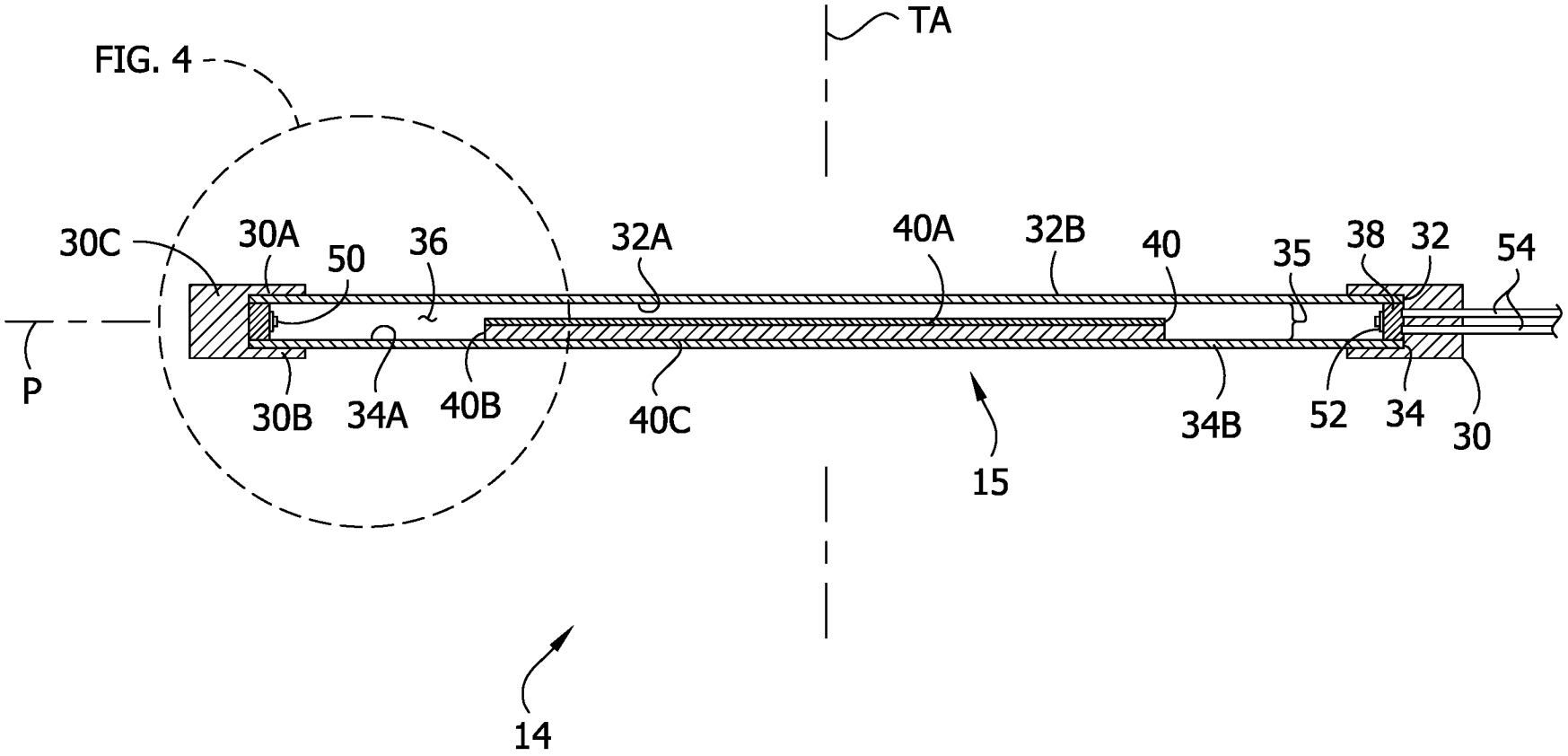
FIG. 3 is a cross section of the door.
Figure 4:
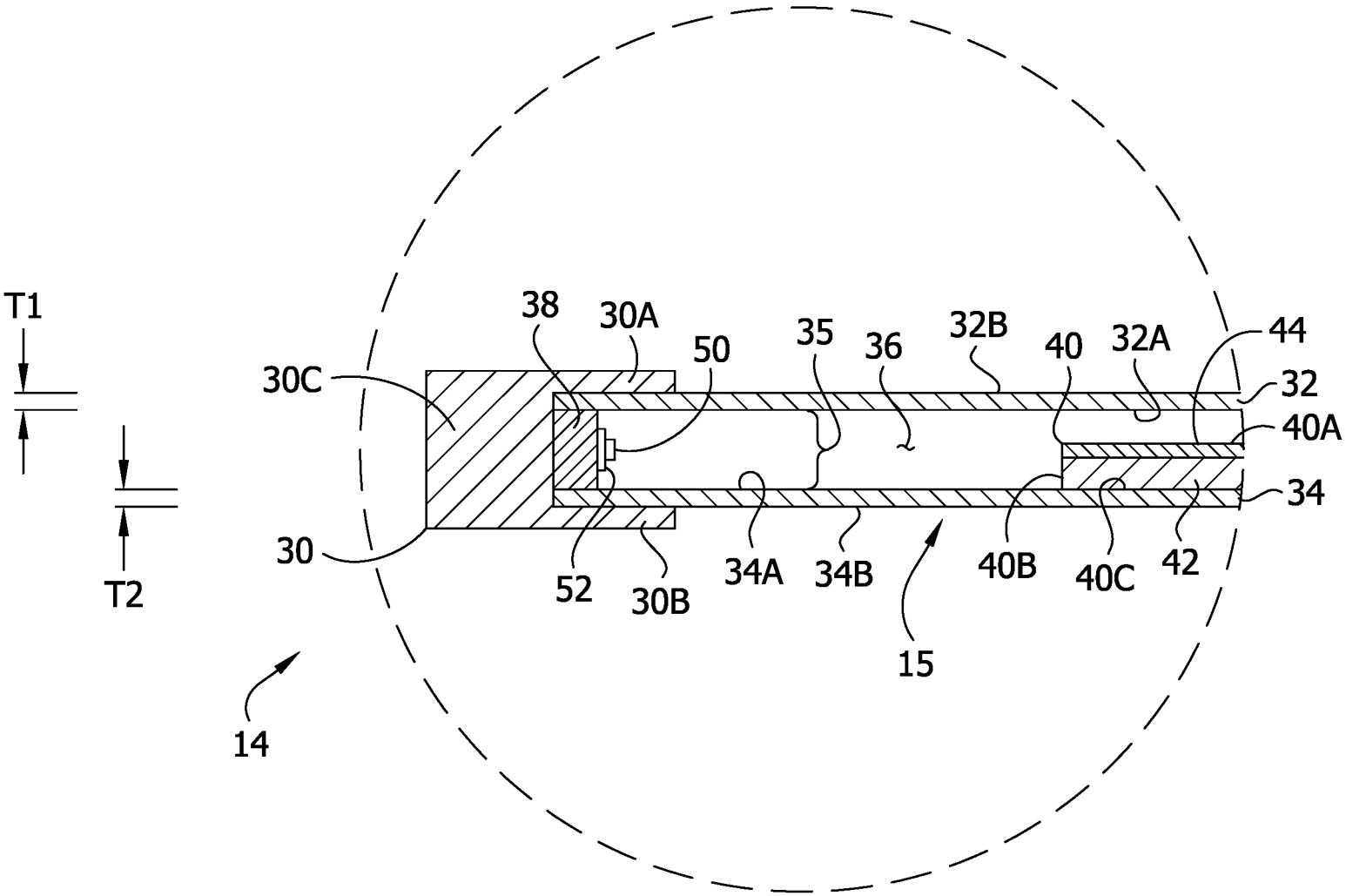
FIG. 4 is an enlarged view of a portion of FIG. 3.

Referring to FIGS. 2-4, the illuminating display window 15 is mounted on a frame 30 of the door 14, which is in turn hingedly mounted on the cabinet 12. The illustrated frame 30 is generally rectangular and includes top, bottom, and first and second side frame portions that extend along top, bottom, and first and second side edge margins of the window 15, respectively. Thus, the frame 30 generally extends around the perimeter edge margin of the window 15.

It is understood that in other embodiments frames can have other shapes which may correspond with the perimeter edge margins of windows having other shapes. As shown in FIG. 3, sections of the frame portions have C-shaped cross-sectional shapes. In cross section, each of the top, bottom, and side frame portions includes opposing, spaced apart first and second arm section 30A, 30B, respectively, and a base section 30C that extends between the first and second arm sections at an outboard end of the frame portion. The perimeter edge margin of the window 15 is received in a gap between the opposing first and second arm sections 30A, 30B of the frame 30 to secure the window in the frame, such as by adhesive (e.g., glue). It is understood that in other embodiments the frame could have other cross-sectional shapes and/or the frame may be of other constructions. For example, the first and second arm sections 30A, 30B may be parts of separate respective frame components fastened to one another to form the fame 30. Moreover, although not shown, a gasket (e.g., PVC gasket) may be secured to a rear of the frame 30 to form a seal with the cabinet 12 when the door 14 is closed.

As shown in FIGS. 3-4, the illustrated the window 15 is in the form of a double-pane window. In other embodiments, the window may comprise a single pane or more than two panes. The window 15 comprises a front pane 32 and a rear pane 34. The front and rear panes 32, 34 are generally parallel and oppose one another. The panes 32, 34 are suitably formed from a transparent or semitransparent material such as glass, plastic (e.g., acrylic), etc. In the illustrated embodiment, each pane 32, 34 is generally the same size and shape (e.g., each pane is generally rectangular). The panes 32, 34 are arranged so that their perimeter edge margins are substantially aligned and generally oppose one another. In the assembled door 14, the perimeter edge margins of the panes 32, 34 are received in the gap between the arm sections 30A, 30B of the frame 30. Each pane 32, 34 has an internal surface 32A, 34A, an external surface 32B, 34B, and a thickness T1, T2 (FIG. 4) extending from the respective internal surface to the respective external surface along an axis TA. The external surface 32B of the front pane 32 forms the outer surface of the window 15 and faces forward away from the refrigerated interior 24 when the door 14 is in the closed position. The internal surface 32A of the front pane 32, therefore, faces rearward toward the refrigerated interior 24 when the door 14 is in the closed position. The external surface 34B of the inner pane 34 forms the inner surface of the window 15 and faces rearward toward the refrigerated interior 24 when the door 14 is in the closed position. The internal surface 34A of the inner pane 34, therefore, faces forward away from the refrigerated interior 24 when the door 14 is in the closed position.

The internal surfaces 32A, 34A of the window panes 32, 34 are spaced apart from one another along the axis TA to define a gap 35 therebetween. One or more spacers 38 extend between and engage the internal surfaces 32A, 34A along the perimeter edge margins of the panes 32, 34 to hold the panes in spaced apart relation with one another. In the illustrated embodiment, the spacer 38 has a substantially rectangular cross-sectional shape in the form of a bar and extends along the top, bottom, and first and second side edge margins of the panes 32, 34. The spacer 38 may be constructed from metal, plastic, other materials, or combinations thereof. The spacer 38 may be a "warm-edge" spacer. A suitable "warm-edge" spacer 38 may be constructed from polymer EPDM (ethylene-propylene-diene-monomer) foam, such as the SUPER SPACER® sold by Quanex Building Products. Other types of spacers, including spacers made from aluminum or other metal, may be used. The spacer 38 forms a seal that sealingly engages the internal surfaces 32A, 34A of the window panes 32, 34, whereby the window panes and the spacer 38 define a sealed chamber 36. For example, in one or more embodiments, the spacer 38 may be joined to the internal surfaces 32A, 34A of the window panes 32, 34 by an epoxy to form a seal. In other embodiments, the sealed chamber 36 may be sealed in other ways. As is known in the art, the sealed chamber 36 can be filled with an inert gas such as argon, nitrogen, etc.

Referring to FIGS. 2-4, the illuminating display window 15 further includes a graphic element 40 which may be designed and configured to communicate information regarding the merchandise/product in the merchandiser refrigerator 10. The graphic element 40 is disposed within the sealed chamber 36 and supported on the window 15 at a location inboard of the perimeter edge margins of the window panes 32 34. As explained in further detail below, an electromagnetic radiation source 50 (e.g., a source of non-visible light) is configured to emit electromagnetic radiation toward the graphic element 40, and the graphic element is configured to fluoresce in response to absorption of the electromagnetic radiation and emit visible light in a forward direction through the front pane 32 and toward the observer, while also allowing merchandise in the cabinet 12 to be visible through the door when the door is closed.

Referring to FIG. 4, the illustrated graphic element 40 comprises a sheet of material having a major surface 40A (e.g., a front face) that faces forward, a rear face 40C opposite the major surface, and perimeter surface 40B extending between the major and rear face and defining a perimeter of the graphic element. In use, the major surface 40A is oriented to be visible to an observer outside of the refrigerator 10. Suitably, the major surface 40A can have a decorative or ornamental appearance so that it is visually appealing to the observer. Moreover, perimeter surface 40B of the graphic element 40 may have a shape corresponding to an outline of a logo, mark, or other symbol. In the illustrated embodiment, the major surface 40A is substantially planar, but it could non-planar (e.g., three-dimensional shape), in other embodiments. In one or more embodiments, the perimeter surface 40B is oriented substantially perpendicular to the major surface 40A. In certain embodiments some or the entire perimeter surface 40B could be chamfered toward the rear face 40C at a non-perpendicular angle to the major surface 40A. In addition, some or the entire perimeter surface 40B of the graphic element 40 could be curved about the perimeter of the graphic element. As will be explained below, the perimeter surface 40B of the graphic element 40 is configured to receive electromagnetic radiation from the electromagnetic radiation source 50, and in response, the graphic element 40 is configured to fluoresce visible light.

In the illustrated embodiment, the graphic element 40 is preferably mounted on the window 15 inside the sealed chamber 36 between the window panes 32, 34. Thus, the graphic element 40 is offset along the axis TA from the internal surface 32A, 34A of each window pane 32, 34 away from the respective external surface 32B, 34B. In other embodiments, the graphic element 40 could be mounted outside the sealed chamber 36, such as behind the rear window pane 34 or in front of the front window pane 32. In the illustrated embodiment, the rear surface 40C of the graphic element 40 is joined to the internal surface 34A of the rear window pane 34. For example, the mounting surface 40C can be adhered to the inner surface 34A by an epoxy or other adhesive. In the illustrated embodiment, the major surface 40A opposes and is spaced apart from the internal surface 34A of the front window pane 32, although the major surface 40A by abut the internal surface. In another embodiment, the major surface 40A of the graphic element 40 is joined (e.g., adhered) to the inner surface 32A of the front pane 32. The graphic element 40 may be mounted on the window in still other ways in other embodiments.

The graphic element 40 includes fluorescent material. Various techniques can be used to include fluorescent material in the graphic element 40. In the illustrated embodiment, the graphic element 40 includes a substrate layer 42 and a graphic layer 44 that defines at least a portion of the major surface 40A. In one or more embodiments, the substrate layer 42 is suitable for mounting the graphic element 40 on one of the window panes 32, 34. In certain embodiments, the substrate layer 42 comprises a fluorescent material combined with (e.g., embedded in) a transparent or semitransparent material (e.g., plastic material). For example, in one embodiment, the substrate layer 42 comprises a fluorescent acrylic, such as a transparent or semitransparent fluorescent acrylic. The graphic layer 44 can, in one or more embodiments, include a pattern of one or more colors depicting the desired graphic design. For example, in certain embodiments, the graphic layer 44 comprises ink, such as fluorescent ink, supported on the substrate layer to depict the desired graphic design. In the illustrated embodiment, the graphic layer 44 comprises a metal plate that is joined to the substrate layer 42 and includes fluorescent ink applied to an outer surface thereof by sublimation, for example. In other embodiments, fluorescent ink could be sublimated directly onto the substrate layer 42 or applied to one of the metal plate and the substrate layer using another ink depositing technique. In other embodiments, the graphic element 40 may include the substrate layer 42, but not the graphic layer 44. In yet other embodiments, the graphic element 40 may include the graphic layer 44, but not the substrate layer 42. The graphic element could have still other configurations in other embodiments.

Referring to FIGS. 1-3, in one or more embodiments the electromagnetic radiation source 50 is configured to emit electromagnetic radiation having a wavelength in a non-visible spectrum. Emitting radiation in a non-visible spectrum emphasizes the graphic element 40 by fluorescently illuminating the graphic element without substantially illuminating other portions of the window 15. It will be understood that an electromagnetic radiation source that is configured to emit electromagnetic radiation having a wavelength in a non-visible spectrum can also emit electromagnetic radiation in the visible spectrum. Most electromagnetic radiation sources that are configured to emit radiation having a wavelength in the non-visible spectrum (e.g., ultraviolet light sources, infrared light sources, etc.) emit a small amount of visible light. Thus, in one or more embodiments, the electromagnetic radiation source 50 is configured to emit radiation, and the emitted radiation includes (i) visible radiation having a wavelength in the visible light spectrum and (ii) non-visible radiation having a wavelength in the non-visible spectrum. In certain embodiments, the preponderance of the radiation emitted by the radiation source 50 has a wavelength in a non-visible spectrum. For example, emission spectra for the electromagnetic radiation source 50 may be greater for wavelengths in a non-visible spectrum than for wavelengths in the visible spectrum. In the illustrated embodiment, the electromagnetic radiation source 50 emits ultraviolet (UV) light in a UV spectrum. More specifically, the illustrated window 15 comprises an LED strip 52 comprising a plurality of UV diodes 50 (each, broadly, an electromagnetic radiation source) at spaced apart locations along the strip. Wires 54 (FIG. 3) extend from the light strip 50 through the frame 30 to connect the light strip to a power source (not shown).

In general, the UV light strip 52 is supported on the window 15 at a location adjacent the perimeter edge margin of the window panes 32, 34. The diodes 50 are arranged to emit UV radiation in an inboard direction toward the perimeter surface 40B of the graphic element 40 within the sealed chamber 36. In the illustrated embodiment, the UV diodes 50 are disposed in the sealed chamber 36, although the UV diodes may be disposed outside the sealed chamber in other embodiments. In the illustrated embodiment, the diodes 50 and the graphic element 40 are each generally aligned in the same plane P (FIG. 3) oriented perpendicular to the axis TA. (The window panes 32, 34 are each spaced apart from the plane P.) The UV light strip 52 can be secured to the window 15 at a location inboard of terminal points of the perimeter edge margins of the window panes 32, 34 (e.g., inside the sealed chamber 36). More specifically, the illustrated UV light strip 52 is mounted on the inboard surface of the spacer 38. In certain embodiments, the UV light strip 52 extends along the top segment of the spacer 38 (e.g., along the top edge margin of the window 15) and along upper portions of the side segments of the spacer 38 (e.g., generally along portions of the side edge margins of the window 15) that are aligned with the graphic element 40. Thus, the illustrated window 15 includes a plurality of UV diodes 50 at spaced apart locations adjacent the perimeter edge margins of the window panes 32, 34. In other embodiments, the UV light strip 52 could be positioned at other locations along the perimeter edge margins of the window panes 32, 34. Moreover, other types of individual or multipoint radiation sources could be used in other embodiments.

Unlike an edge-lit window, the graphic element 40 is configured to emit visible light without directing visible light or other radiation into an etched or engraved graphic acrylic sheet. It has been found that imperfections and debris in and on the etched or engraved acrylic sheet is visible to the observer, and even enhanced, when the graphic is illuminated by visible light being internally reflected. The use of non-visible electromagnetic radiation (e.g., UV) to fluoresce the graphic element 40 minimizes the appearance of debris and/or imperfections in and on the graphic element.

In the illustrated embodiment, the first and second arm sections 30A, 30B of the frame 30 form a shield of the window 15 that is opaque to UV radiation (broadly, emitted electromagnetic radiation) to block radiation emitted from the diodes 50 in a forward direction toward an observer looking into the window 15 and/or in a rearward direction toward merchandise in the refrigerated interior 24. Suitably, the frame 30 is shaped and arranged to extend along the entire perimeter edge margin of the window 15 so that the shield covers each of the diodes 50 in the light strip 52 in the direction of the axis TA. The first arm section 30A forms a front segment of the shield that is in front of the UV light strip 52 to block radiation emitted from the diodes 50 in a forward direction along the axis TA. The first arm section 30A extends along the front surface 32B of the window 15 (e.g., the external surface 32B of the front window pane 32) from an outboard end spaced apart outboard of the diodes 50 to an inboard end spaced apart inboard of the diodes and inboard of the perimeter edge margins of the front window pane. The second arm section 30B forms an inner segment of the shield that is rearward of the UV light strip 52 to block radiation emitted from the diodes 50 in a rearward direction along the axis TA. The second arm section 30B extends along the inner surface 34B of the window 15 (e.g., the external surface 34B of the inner window pane 34) from an outboard end spaced apart outboard of the diodes 50 to an inboard end spaced apart inboard of the diodes and inboard of the perimeter edge margin of the inner window pane. Although the illustrated embodiment uses a C-shaped door frame 30 to form a radiation shield, other embodiments can use other structures as opaque shields to block radiation from being emitted rearward and/or forward from an illuminating display window.

Having described an exemplary illuminating display window 15 in detail, a method of making the display window will now be described before discussing use of the display window and the merchandiser display unit 10 in greater detail. In one embodiment, to form the illustrated graphic element 40, a plate (e.g., a metal plate) and a fluorescent sheet (e.g., a semitransparent, fluorescent acrylic panel) are formed with desired shapes to correspond to a desired graphic, such as a logo, mark, or other symbol. The desired shapes may be formed by, for example, machining stock, additive manufacturing, etc. Fluorescent ink is deposited on the plate in a predefined pattern. In one or more embodiments, the fluorescent ink is deposited on the plate using sublimation. The fluorescent ink can also be deposited on the plate in other ways in certain embodiments. The shaped metal plate is attached to the shaped fluorescent sheet, whereby the metal plate forms the graphic layer 40B and the fluorescent sheet forms the substrate layer 40A of the graphic element 40.

The graphic element 40 is attached to the window 15 by, for example, adhering the rear face 40C to the internal surface 34A of the rear window pane 34 using an epoxy or other adhesive. The UV light strips 52 are attached to the inboard surfaces of the spacer 38, and the spacers are sealingly attached to the internal surfaces 32A, 34A of the window panes 32, 34 along the perimeter edge margins. Attaching the UV light strips 52 to the spacer 38, attaching the spacers to the window panes 32, 34, and attaching the graphic element 40 to the inner window pane operatively aligns the diodes 50 with the graphic element for emitting UV radiation toward the perimeter surface 40B of the graphic element as described above. After being installed, the spacer 38 hold the window panes 32, 34 in position to define the sealed chamber 36 between the internal surfaces 32A, 34A. The window 15 is installed in the frame 30 so that the perimeter edge margin of the window is received in the gap between the arm sections 30A, 30B. Installing the window 15 in the frame 30 aligns the UV shield defined by the arm sections 30A, 30B with the UV light strip 52 to block UV radiation emitted from the diodes 50 in forward and rearward directions along the axis TA. If used in the refrigerator 10, after the window 15 is installed in the frame 30, the frame can be hingedly or slidably mounted on the cabinet 12 to selectively open and close the door 14.

In use, the diodes 50 emit UV radiation from multiple points along the perimeter edge margins of the panes in inboard directions. Because the UV radiation is not directed at the edges of the window panes 32, 34 and minimal radiation having a wavelength in the visible spectrum is emitted, the emitted radiation does not tend to illuminate imperfections in and on the window panes. The UV light strip 52 conveys the UV radiation to the perimeter edge surface 40B of the graphic element 40. In response to the fluorescent material absorbing the UV radiation, the graphic element 40 fluoresces to transmit visible light forward from the major surface 40A, especially adjacent the perimeter surface 40C. In the illustrated embodiment, the fluorescent graphic element 40 transmits visible light forward through the front window pane 32 to illuminate the graphic element to observers situated in front of the window 15. The merchandise/product in the refrigerated interior 24 is still visible by the observer through the window 15. The shield of the frame 30 blocks UV radiation from being conveyed directly toward the observer and toward the merchandise/product in the interior 24.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above apparatuses, systems, and methods without departing from the scope of the invention, it is intended that all matter contained in the above description and shown in the accompanying drawings shall be interpreted as illustrative and not in a limiting sense.

What is claimed is:

1. An illuminating display window comprising:

a window pane having a perimeter edge margin, a front surface, a rear surface opposite the front surface, and a thickness extending from the front surface to the rear surface;

a graphic element comprising a fluorescent material, the graphic element being supported on the window at a location inboard of the perimeter edge margin of the window pane, the graphic element having a major surface facing forward and a perimeter surface extending transverse to the major surface and defining a perimeter of the graphic element; and an electromagnetic radiation source configured to emit electromagnetic radiation having a wavelength in a non-visible spectrum, the electromagnetic radiation source supported on the window at a location adjacent the perimeter edge margin of the window pane, the electromagnetic radiation source being configured to emit the electromagnetic radiation to the perimeter surface of the graphic element whereby the graphic element fluoresces to transmit visible light that is visible to an observer in front of the window pane;

wherein the electromagnetic radiation source is offset from the window pane along an axis perpendicular to the window pane;

wherein the perimeter edge margin includes top perimeter margin segment, a bottom perimeter margin segment, and opposite left and right side perimeter margin segments, the electromagnetic radiation source comprising a first electromagnetic radiation source located along one of the top perimeter margin segment and the bottom perimeter margin segment and a second electromagnetic radiation source located along one of the opposite left and right side perimeter margin segments, the first and second electromagnetic radiation sources configured to simultaneously emit electromagnetic radiation to the perimeter surface of the graphic element.

2. The illuminating display window set forth in claim 1, wherein each of the graphic element and the electromagnetic radiation source is disposed behind the window pane.

3. The illuminating display window set forth in claim 2, wherein the graphic element is configured to emit the visible light through the thickness of the window pane.

4. The illuminating display window set forth in claim 1, further comprising a shield opaque to the emitted electromagnetic radiation and including at least a front segment in front of electromagnetic radiation source to block electromagnetic radiation emitted from the electromagnetic radiation source in a generally forward direction.

5. The illuminating display window set forth in claim 4, wherein the shield further comprises a rear segment opposing the front segment and disposed behind the electromagnetic radiation source to block electromagnetic radiation emitted in a generally rearward direction.

6. The illuminating display window set forth in claim 4, wherein the front segment of the shield extends from an outboard end spaced apart outboard of the electromagnetic radiation source to an inboard end spaced apart inboard of the electromagnetic radiation source.

7. The illuminating display window set forth in claim 6, wherein the inboard end is spaced apart inboard of the perimeter edge margin of the window pane.

8. The illuminating display window set forth in claim 4, further comprising a frame extending around the perimeter edge margin of the window pane and defining the shield.

9. The illuminating display window set forth in claim 8, wherein the frame is configured to be one of slidably and pivotably secured to a cabinet of a refrigerator unit for selectively opening and closing the refrigerator unit.

10. The illuminating display window set forth in claim 1, wherein the graphic element comprises a substrate layer and a graphic layer defining at least a portion of the major surface of the graphic element and wherein at least one of the substrate layer and the graphic layer is fluorescent.

11. The illuminating display window set forth in claim 10, wherein the substrate layer is transparent.

12. The illuminating display window set forth in claim 10, wherein the graphic layer comprises a fluorescent ink.

13. The illuminating display window set forth in claim 10, wherein the graphic layer further comprises a metal plate, the fluorescent ink being applied to the metal plate by sublimation.

14. The illuminating display window set forth in claim 1, wherein the window pane constitutes a front window pane, the illumination display window further comprising a rear window pane generally opposing and disposed behind the front window pane, the window defining a sealed chamber between the front and rear window panes, wherein the graphic element and the electromagnetic radiation source are disposed in the sealed chamber.

15. The illuminating display window set forth in claim 1, wherein the electromagnetic radiation source is configured to emit electromagnetic radiation having a wavelength in an ultraviolet spectrum.

16. The illuminating display window set forth in claim 1, in combination with a cabinet having an interior in which merchandise is receivable, wherein the illuminating display window is mounted on the cabinet such that the interior of the cabinet is visible through the illuminating display window.

17. The illuminating display window set forth in claim 16, in combination with a door mounted on the cabinet, wherein the door comprises the illuminating display window.

18. The illuminating display window set forth in claim 17, wherein the cabinet is refrigerated.

19. The illuminating display window set forth in claim 1, wherein the illuminating display window comprises a fluid gap between the rear surface of the window pane and the major surface of the graphic element.

20. An illuminating display window comprising:

a window pane having a perimeter edge margin, a front surface, a rear surface opposite the front surface, and a thickness extending from the front surface to the rear surface;

a graphic element comprising a fluorescent material, the graphic element being supported on the window at a location inboard of the perimeter edge margin of the window pane, the graphic element having a major surface facing forward and a perimeter surface extending transverse to the major surface and defining a perimeter of the graphic element; and an electromagnetic radiation source configured to emit electromagnetic radiation having a wavelength in a non-visible spectrum, the electromagnetic radiation source supported on the window at a location adjacent the perimeter edge margin of the window pane, the electromagnetic radiation source being configured to emit the electromagnetic radiation to the perimeter surface of the graphic element whereby the graphic element fluoresces to transmit visible light that is visible to an observer in front of the window pane;

wherein the electromagnetic radiation source is offset from the window pane along an axis perpendicular to the window pane;

wherein the illuminating display window comprises a fluid gap between the rear surface of the window pane and the major surface of the graphic element.

* * * * *